US005944982A

United States Patent [19]

Lomas

[11] Patent Number: 5,944,982

[45] **Date of Patent: *Aug. 31, 1999**

[54] METHOD FOR HIGH SEVERITY CRACKING

[75] Inventor: David A. Lomas, Barrington, Ill.

[73] Assignee: UOP LLC, Des Plaines, Ill.

[ * ] Notice: Under 35 U.S.C. 154(b), the term of this patent shall be extended for 00 days.

[21] Appl. No.: 09/166,355

[22] Filed: Oct. 5, 1998

[51] Int. Cl.[6] ..... C10G 11/18

[52] U.S. Cl. ..... 208/164; 208/78; 208/157; 208/161; 208/153; 422/161

[58] Field of Search ..... 208/164, 157, 208/161, 78, 153, 113; 422/161

[56] References Cited

U.S. PATENT DOCUMENTS

| | | | |
|---|---|---|---|
| 2,550,290 | 4/1951 | Pelzer et al. | 196/52 |
| 2,882,332 | 4/1959 | Reisinger | 174/59 |
| 2,915,457 | 12/1959 | Abbott et al. | 208/74 |
| 3,161,582 | 12/1964 | Wickham | 208/74 |
| 3,607,129 | 9/1971 | Carson | 23/288 S |
| 3,766,838 | 10/1973 | Knoll et al. | 95/4.5 R |
| 4,830,728 | 5/1989 | Herbst et al. | 208/78 |
| 4,966,681 | 10/1990 | Herbst et al. | 208/74 |
| 4,990,239 | 2/1991 | Derr, Jr. et al. | 208/68 |
| 5,082,983 | 1/1992 | Breckenridge et al. | 585/475 |
| 5,152,883 | 10/1992 | Melin et al. | 208/61 |
| 5,310,477 | 5/1994 | Lomas | 208/78 |
| 5,401,389 | 3/1995 | Mazzone et al. | 208/89 |
| 5,582,711 | 12/1996 | Ellis et al. | 208/76 |

*Primary Examiner*—Walter D. Griffin
*Assistant Examiner*—Tung Doan
*Attorney, Agent, or Firm*—Thomas K. McBride; John G. Tolomei

[57] ABSTRACT

A process for the dual riser contacting of a primary feed and a secondary recycle feed fraction uses independent recovery of the separate streams from the riser cracking zone to improve the product yields and properties. Separate recovery segregates the upgraded recracked components from the rest of the primary cracked products. The benefits of selective of recracking are lost if the upgraded products from the recycle stream become recombined with the primary cracked product. The selectively recovered recycle feed may undergo hydroprocessing to hydrogenate, hydrocrack and/or hydrotreatmement before recracking. The process can also make highly efficient use of the high residual activity in the catalyst that has contacted the secondary feed.

9 Claims, 2 Drawing Sheets

METHOD FOR HIGH SEVERITY CRACKING

BACKGROUND OF THE INVENTION

1. Field of the Invention

This invention relates generally to processes for the fluidized catalytic cracking (FCC) of heavy hydrocarbon streams such as vacuum gas oil and reduced crudes. More specifically, this invention relates generally to processes for the catalytic cracking of heavy hydrocarbon feeds and the sequential recracking of recovered product fractions with independent recovery of separate product streams from a single reactor vessel.

2. Description of the Prior Art

The FCC process uses gas streams to contact finely divided streams of catalyst particles and effects contact between the gas and the particles. The FCC processes, as well as separation devices used therein are fully described in U.S. Pat. Nos. 5,584,985 and 4,792,437, the contents of which are hereby incorporated by reference.

The FCC process is carried out by contacting the starting material whether it be vacuum gas oil, reduced crude, or another source of relatively high boiling hydrocarbons with a catalyst made up of finely divided or particulate solid material. The catalyst is transported in a fluid-like manner by passing gas or vapor through it at sufficient velocity to produce a desired regime of fluid transport. Contact of the oil with the fluidized material catalyzes the cracking reaction. The cracking reaction deposits coke on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from a stripper, that removes adsorbed hydrocarbons and gases from catalyst, to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The FCC unit cracks gas oil or heavier feeds into a broad range of products. Cracked vapors from the FCC reactor enter a separation zone, typically in the form of a main column, that provides a gas stream, a gasoline cut, cycle oil and heavy residual components. The gasoline cut includes both light and heavy gasoline components. Major component of the heavy gasoline fraction comprises heavy single ring aromatics and condensed ring compounds.

The recracking of product fractions from the initially cracked FCC product is well known. Recracking can provide a variety of controlled reactions for shape-selective cracking, dealkylation, dehydrogenation, isomerization, and hydrogen transfer reactions. It is well known to contact the feed fraction and recracked freed fractions in separate reaction zones. The prior art also discloses the use of separate risers for the contacting of a primary feed and a secondary feed. Unconverted material from these reactions become rich in highly refractory multi-ring aromatics which consist essentially of methyl and ethyl alkyl groups. The basicity of the these multi-ring aromatics gives them a high affinity for acid cites that causes them to proceed via condensation and hydrogen transfer-type reactions to form coke. Methods are sought to more efficiently contact the primary and recracked feeds, separate the product components from the catalyst streams, use the available activity in the catalyst to its fullest extent, and improve the overall apparatus arrangement for the primary feed contacting and recycle fraction recontacting.

A number of specific process advantages can be obtained by such an arrangement. Such a process can maximize gasoline production while producing a higher quality gasoline product. Suitable processes will eliminate the presence of high boiling aromatics from FCC gasoline. Alternately, middle distillate production can also be improved where desired. End insert.

Particular benefits can be obtained by improvements to the separation of the catalyst from the cracked hydrocarbons streams. The most common method of separating particulate solids from a gas stream uses a cyclonic separation. Cyclonic separators are well known and operate by imparting a tangential velocity to a gases containing entrained solid particles that forces the heavier solids particles outwardly away from the lighter gases for upward withdrawal of gases and downward collection of solids. Cyclonic separators usually comprise relatively small diameter cyclones having a tangential inlet on the outside of a cylindrical vessel that forms the outer housing of the cyclone.

Cyclones for separating particulate material from gaseous materials are well known to those skilled in the art of FCC processing. In the operation of an FCC cyclone tangential entry of the gaseous materials and catalyst creates a spiral flow path that establishes a vortex configuration in the cyclone so that the centripetal acceleration associated with an outer vortex causes catalyst particles to migrate towards the outside of the barrel while the gaseous materials enter an inner vortex for eventual discharge through an upper outlet. The heavier catalyst particles accumulate on the side wall of the cyclone barrel and eventually drop to the bottom of the cyclone and out via an outlet and a dip leg conduit for recycle through the FCC arrangement. Cyclone arrangements and modifications thereto are generally disclosed in U.S. Pat. Nos. 4,670,410 and 2,535,140.

U.S. Pat. Nos. 4,397,738 and 4,482,451, the contents of which are hereby incorporated by reference, disclose an alternate arrangement for cyclonic separation that tangentially discharges a mixture of gases and solid particles from a central conduit into a containment vessel. The containment vessel has a relatively large diameter and generally provides a first separation of solids from gases. This type of arrangement differs from ordinary cyclone arrangements by the discharge of solids from the central conduit and the use of a relatively large diameter vessel as the containment vessel. In these arrangements the initial stage of separation is typically followed by a second more compete separation of solids from gases in a traditional cyclone vessel.

It is an object of this invention to improve the operation of dual riser systems for contacting a heavy FCC feed and a recracked lighter feed fraction using a dual riser reactor arrangement.

It is another object of this invention to recontact an intermediate product fraction from the fluidized catalytic cracking of a primary feed fraction with fresh catalyst and to contact the primary feed with a mixture of spent catalyst from the recontacting zone and regenerated catalyst.

It is a further object of this invention to provide an apparatus for recontacting a recycled FCC product fraction with fresh catalyst while returning the partially spent catalyst for recycle to a primary feed contacting conduit.

Another object of this invention is the recracking of heavy gasoline components at high severity to reduce the end point of FCC gasoline with an improved FCC arrangement.

DISCLOSURE STATEMENT

U.S. Pat. No. 2,883,332 describes the use of two separate bed type reaction zones in an FCC process and the charging of a recycle stock to one of the reaction zones and the recovery of the product streams from both of the reaction zones through a common recovery system.

U.S. Pat. No. 3,161,582 teaches the use of riser reaction zone that converts a first feed and discharges the converted feed into a second bed type reaction zone that treats additional more refractory feed. All of the converted feeds are recovered from a common dilute phase collection zone in the reactor.

U.S. Pat. No. 2,550,290 discloses an FCC process that contacts an FCC charge oil in a first reaction vessel, separates the products from the first reaction vessel, and contacts the bottoms stream from the product separation in a separate second reaction vessel.

U.S. Pat. No. 2,915,457 describes the treatment of an FCC feed in a first riser type catalytic cracking vessel, separation of cracked hydrocarbons from the first vessel into a gasoline product, a heavy residual stream and a gas oil stream, hydrotreating of the gas oil stream, cracking of the hydrotreated gas oil in a second reaction vessel and recycling of gas oil and heavier cracked components in the second reaction vessel.

U.S. Pat. No. 3,607,129 shows an apparatus for cracking a heavy FCC feedstock in a riser conversion zone, discharging the cracked product into an FCC reactor vessel, cracking hydrotreated or in hydrotreated light cycle oil in a fluidized catalyst bed in a lower portion of the reaction vessel and withdrawing the cracked products from the riser and the dense bed through a common conduit.

U.S. Pat. No. 3,766,838 shows the cracking of naphtha stream in a fluidized catalytic cracking process.

U.S. Pat. No. 5,082,983 teaches the introduction of light reformate stream into an FCC riser.

U.S. Pat. 4,689,206 discloses a separation and stripping arrangement for an FCC process that tangentially discharges a mixture of catalyst and gases into a separation vessel and passes gases upwardly from a lower stripping zone into a series of baffles for displacing hydrocarbons from the catalyst within the separation vessel.

U.S. Pat. No. 2,915,457 shows multiple-staged catalytic cracking of primary feed and a recycled, cracked product fraction in a separate catalytic cracking zone using spent catalyst from the primary cracking zone.

U.S. Pat. No. 4,830,728 shows the cracking of a primary FCC feed using one type of catalyst in a primary reaction zone and a cracking of a naphtha feed in a second riser reaction zone using a substantially segregated catalyst to independently recover separate primary and secondary feeds from the reaction zones.

U.S. Pat. No. 4,990,239 discloses an FCC process for improving the production of middle distillate fuels by recycling a hydrotreated and hydrocracked light cycle oil to the primary feed of the FCC reaction zone.

U.S. Pat. No. 5,152,883 shows a separate FCC reaction zone for the cracking of a primary FCC feed, the hydrogenation of a bottoms fraction from the cracked FCC product and the recracking of a further separated fraction from the hydrogenation zone effluent in a separate catalytic cracking zone.

U.S. Pat. No. 5,401,389 discloses a catalyst and method for upgrading light cycle oil to a low sulfur gasoline by hydrodesulfurization and hydrogenation for catalytic cracking of the light cycle oil fraction.

U.S. Pat. No. 5,310,477 discloses a riser reaction zone and a fixed bed reaction zone and a single reactor vessel for the catalytic cracking of a primary FCC feed and a heavy gasoline or light cycle oil feed that may undergo optional hydrotreating. The arrangement also shows the potential for separate recovery of the primary and secondary products in separate fractionation zones.

U.S. Pat. No. 5,582,711 discloses an FCC process that uses separate risers for the contacting of a primary feed and a hydrotreated product fraction recovered from the cracked product of the primary feed. The reactor arrangement delivers both products to a common fractionation column.

BRIEF SUMMARY OF THE INVENTION

It has now been discovered that a process for the catalytic conversion of heavy hydrocarbons by the sequential fluidized cracking and recracking of feed and product fractions is improved by a dual contacting conduit arrangement that facilitates independent recovery of a primary cracked product and a recracked product. The process cracks the recycled product fraction with regenerated catalyst and cracks the primary feed with a least some regenerated catalyst. The separation of the recovered feed product components preserves the improved quality of a secondary recracked product that may be independently recovered and have improved properties relative to the properties that result from combined recovery of the cracked and recracked products in a single fractionation zone.

The dual contacting conduit arrangement can be used with feed fractions varying from heavy naphtha to heavy cycle oil, depending upon the desired secondary product. The processing of the heavier feed fractions through the reactor vessel as an independent feed permits independent control of the feed residence time in the second reaction zone and high catalyst to oil ratios. Additional treatment steps such as hydrodesulfurization and hydrogenation of the primary cracked product fraction before recycle to the separate contacting conduit can further improve the quality of the recracked recycle product. Hydrotreatment of heavy naphtha and light cycle oils are particularly effective in improving the octane of the gasoline product for the recracked recycle stream.

The process arrangement of this invention provides substantially different modes of operation in the dual contacting conduits. The reactants in the secondary contacting conduit undergo relatively higher severity cracking, with a higher catalyst to hydrocarbon ratio, than in the primary contacting conduit. For example contact in the higher severity contacting conduit can further dealkylate heavy aromatics to $C_7$ and $C_8$ aromatics and act as an independent treating zone for the dealkylation of the heavy gasoline. Thus, this invention applies independent control of two separate reaction transport type reaction zones within one FCC reactor.

The invention is particularly beneficial to producing low sulfur and high octane gasoline. The first conduit cracking zone may operate in a similar manner to most FCC units to provide a cracked product that a main column separates into light products, heavy naphtha and light cycle oil, and heavier components. Heavy naphtha, light cycle oil or both may pass through a hydrotreator for the saturation and desulfurization of the recycle fraction. The treated recycle fraction enters the second contacting conduit to produce a cracked recycle product that enters a separate separation zone for the recovery of a heavy naphtha product that provides a high octane gasoline stream at greater yields to increase the high quality gasoline sent to the gasoline pool.

The invention further promotes the efficient use of catalyst activity. The recycle contacting conduit will typically operate at higher severity conditions. A higher catalyst to oil ratio, relative to the primary feed contacting conduit, provides the higher severity conditions in the recracking contacting conduit. The relatively higher catalyst ratio, particularly for the lighter recycle streams that have a reduced coking tendency, leaves the catalyst exiting the recycle contacting conduit with significant activity. Preferential recovery of the catalyst from the recycle contacting conduit in an isolated separation zone provides for the recycle of this relatively high activity catalyst to the primary contacting conduit. A particular useful apparatus for the separate transfer conduit contacting and preferential recovery of the relatively high activity catalyst forms another part of this invention.

Accordingly, in one embodiment, this invention is a process for the catalytic conversion of a heavy hydrocarbons by the sequential fluidizied cracking and recracking of feed and product fractions. The process contacts a hydrocarbon feed with regenerated catalyst particles in a first contacting conduit and discharges the mixture of feed and catalyst particles into a first particle separator. The first particle separator separates a first contacted stream of particles from a primary product. The process recovers the primary product from the first particle separator and separates the primary product into a relatively heavy stream and a relatively light stream. At least a portion of the relatively light stream passes to a saturation zone to produce a recycle stream. Regenerated catalyst particles contact the recycle stream in a second conduit to recrack the recycle stream and produce a recycle product. A second particle separator separates a second contacted stream of particles from the recycle product for recovery of the recycled product without substantial intermixing with the primary product. The first and second contacted stream of particles undergoes stripping in a stripping zone and the stripped catalyst particles pass into a regeneration zone to provide the regenerated catalyst particles.

In a more specific embodiment, this invention is a process for producing gasoline from a hydrocarbon feed having an initial boiling point of at least 400° F. The process contacts the hydrocarbon feed with regenerated catalyst particles and partially spent catalyst particles in a first conduit at a first weight ratio of catalyst to oil and discharges the mixture of feed and catalyst particles into a first particle separator. The first particle separator separates the first contacted stream of particles from a converted feed. The process further separates the converted feed from the first particle separator into a relatively light stream having an initial boiling point below 400° F. and a relatively heavier stream. At least a portion of the relatively lighter stream undergoes saturation in a saturation zone to produce a recycle stream. Regenerated catalyst particles contact the recycle stream in a second conduit at a second weight ratio of catalyst to oil to recrack the recycle stream and produce a recycle product. The second weight ratio of catalyst to oil exceeds the first catalyst to oil weight ratio. A second particle separator separates a second contacted stream of particles from the recycle product. At least a portion of the second stream of contacted particles passes through the first conduit to supply the spent catalyst. The process recovers the recycled product without substantial intermixing with the converted feed. The first and second contacted stream of particles pass through a common stripping zone that strips hydrocarbon vapors from the particles which then undergo regeneration to provide the regenerated catalyst particles.

In an apparatus embodiment, this invention comprises a reactor vessel and a separation vessel located at least partially therein. A first contacting conduit extends into the separation vessel and defines a discharge opening within the separation vessel. Tangential orientation of the discharge openings imparts a tangential velocity to the stream of particles and gases as they enter the separation vessel to effect an initial separation. A first particle conduit supplies regenerated catalyst to the first contacting conduit and a second particle supply conduit supplies partially spent catalyst to the first contacting conduit. A first feed supply conduit injects a first feed into the first contacting conduit. A particle outlet defined by the separation vessel discharges particles from a lower portion of the separation vessel. A stripping vessel located below the separation vessel receives the discharged particles. The first gas recovery conduit defines a first outlet for withdrawing gaseous fluids from the separation vessel. A second contacting conduit located outside of the separation vessel defines a discharge opening for discharging a stream of particles and gases. A third supply conduit supplies regenerated catalyst to the second contacting conduit. A second feed supply conduit injects a second feed into the second contacting conduit. A separator located outside of the separation vessel receives the stream of particles and gases from the second discharge opening and supplies spent catalyst to the second supply conduit. A second gas recovery conduit defines a second outlet for withdrawing gaseous fluids from the separator in isolation from the gaseous fluids of the first conduit.

DETAILED DESCRIPTION OF THE INVENTION

This invention will be useful for most FCC processes that are used to crack light or heavy FCC feedstocks. The process of this invention can be used to modify the operation and arrangement of existing FCC units or in the design of newly constructed FCC units. The description herein of specific reactor and regenerator components is not meant to limit this invention to those details except as specifically set forth in the claims.

The process and apparatus of this invention preferably uses a separation vessel into which a mixture conduit that contains the mixture of solid particles transported by a gaseous fluid discharges the particles and gaseous fluid mixture. The separation vessel is preferably a cylindrical vessel. The cylindrical vessel promotes the swirling action of the gaseous fluids and solids as they are discharged tangentially from a discharge opening of the mixture conduit into the separation vessel. The separation vessel will preferably have an open interior below the discharge opening that will still provide satisfactory operation in the presence of some obstructions such as conduits or other equipment which may pass through the separation vessel.

The discharge opening and the conduit portion upstream of the discharge opening are constructed to provide a tangential velocity to the exiting mixture of gaseous fluids and solids. The discharge opening may be defined using vanes or baffles that will impart the necessary tangential velocity to the exiting gaseous fluids and solids. Preferably the discharge outlet is constructed with conduits or arms that extend outwardly from a central mixture conduit. Providing a section of curved arm upstream of the discharge conduit will provide the necessary momentum to the gaseous fluids and solids as they exit the discharge opening to continue in a tangential direction through the separation vessel. The separation vessel has an arrangement that withdraws catalyst particles from the bottom of the vessel so that the heavier solid particles disengage downwardly from the lighter gaseous fluids. A bed of solid particles is maintained at the bottom of the separation vessel that extends into the separation vessel. The separated gases from the separation vessel will contain additional amounts of entrained catalyst that are typically separated in cyclone separators. The conduit that carries the mixture of catalyst and gases into the separator may transport the mixture upwardly as in the case of a riser or may transfer catalyst downwardly and discharge catalyst in a downward direction.

Figure 1:
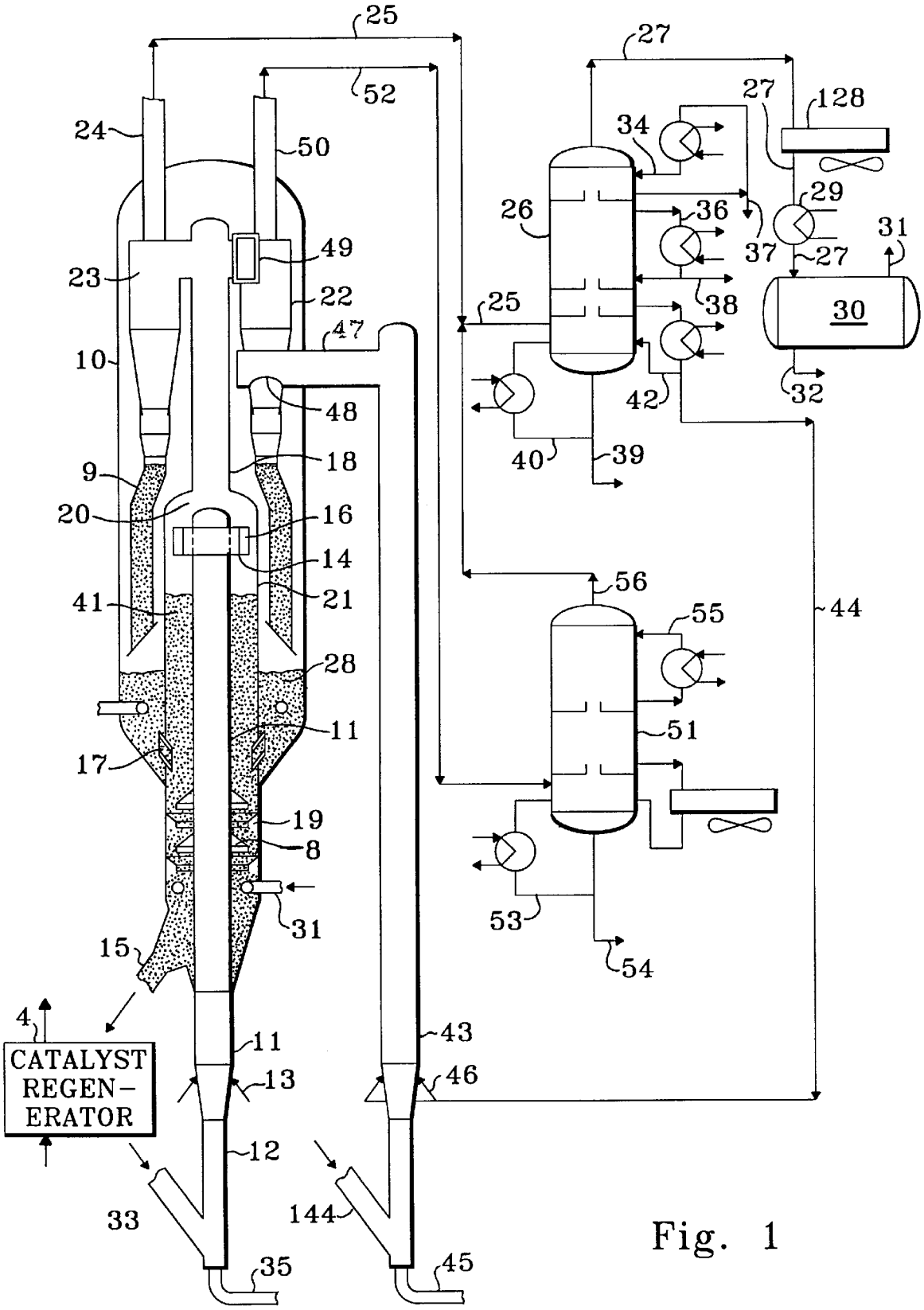
FIG. 1 is sectional elevation of an FCC reactor and schematic diagram of a separation arrangement for recovering products from the FCC reactor.

An overview of the basic process operation can be best understood with reference to FIG. 1. FIG. 1 shows one detailed arrangement for the process and apparatus of this invention. This description applies to the operation and arrangement of the process for the production of middle distillates and liquefied petroleum gas LPG. Beginning with the primary feed, a gas oil enters a central contacting conduit in the form of a riser 11 through feed injection nozzles 13 where it contacts regenerated catalyst from a conduit 33 that has been pre-accelerated by a lift fluid from a conduit 35 in a lower portion 12 of riser 11. Typically, the catalyst circulation rate through the contacting conduit and the input of feed and any lift gas that enters the riser will produce a flowing density of between 3 lbs/ft$^3$ to 20 lbs/ft$^3$ and an average velocity of about 10 ft/sec to 100 ft/sec for the catalyst and gaseous mixture. In the primary reaction zone catalyst will usually contact the hydrocarbons in a catalyst to oil ratio in a range of from 3 to 8, and more preferably in a range of from 4 to 6. The length of the riser will usually be set to provide a residence time of between 0.5 to 10 seconds at these average flow velocity conditions. Other reaction conditions in the riser usually include a temperature of from 875–1050° F.

Expansion of the feed by contact with the hot catalyst lifts the mixture of primary feed and catalyst through riser 11 to a pair of curved conduits in the form of arms 14 having openings 16. Opening 16 directs catalyst and converted feed tangentially outward into a separation vessel 21. Tangential discharge of gases and catalyst from a discharge opening 16 produces a swirling helical pattern about the interior of the separation vessel below the discharge openings 16. Centripetal acceleration associated with the helical motion forces the heavier catalyst particles to the outer portions of the separation vessel 21. This tangential velocity performs an initial separation of spent catalyst particles that pass into a bed 41. The gases, having a lower density than the solids, more easily change direction and begin an upward spiral with the gases ultimately traveling into a gas recovery conduit 18 having an inlet 20 that serves as the gas outlet for the separation vessel. The gases that enter gas recovery conduit 18 through inlet 20 will usually contain a light loading of catalyst particles. Inlet 20 recovers gases from the discharge conduit as well as stripping gases which are hereinafter described. The loading of catalyst particles in the gases entering conduit 18 are usually less than 1 lb/ft.$^3$ and typically less than 0.1 lb/ft$^3$. Cracked products from conduit 18 enter a cyclone 23. Cyclone 23 removes the small amounts of entrained catalyst that are carried upward through conduit 18. The small amount of particles separated by cyclones 23 pass downwardly into a lower bed 28 through dip-leg conduit 9.

Separated particles from bed 28 pass through restricted openings 17 to combine the catalyst from bed 28 with the catalyst collected in bed 41. Openings 17 may comprise a plurality of openings arranged circumferentially around the outside of the separation vessel and can constitute a useful feature of this invention where the reactor vessel surrounds a large portion of the separation vessel. The outlets are located above the bottom outlet of the separation vessel and below the top of the dense catalyst phase maintained within the separation vessel. The restricted openings can provide a good distribution by creating a pressure drop of at least 0.25 psi across the openings. The restricted openings are preferably in the form of nozzles that provide orifices to direct the gas flow into the dense catalyst phase of the separation vessel. The nozzles will preferably have orifice opening diameters of 1 inch or less and a spacing around the circumference of the separation vessel of less 12 inches and more preferably less than 6 inches. To obtain a uniform pressure drop all of the restricted openings are preferably located at the same elevation in the wall of the separation vessel.

The combined catalyst stream passes through stripping zone 19 where it countercurrently contacts a stripping medium that enters the bottom of stripping zone 19 via pipe distributor 31. Countercurrent contact of the catalyst with the stripping fluid through a series of stripping baffles 8 displaces product gases from the catalyst as it continues downwardly through the stripping zone. Catalyst cascades through the series of baffles that project transversely across the cross-section of a stripping zone. Preferably, stripping zone communicates directly with the bottom of the separation vessel and, more preferably, has a sub-adjacent location relative thereto.

Effective utilization of the stripping gas streams from the reactor vessel can be enhanced by utilizing the separator, stripping vessel and reactor arrangement of U.S. Pat. No. 5,584,985 to provide a particular pressure balance between the separation vessel, the surrounding reactor environment, and the restricted openings. The preferred pressure balance maintains a higher pressure in the reactor vessel than the separation vessel. Maintaining the necessary pressure balance demands that a dense catalyst phase extend upward in the reactor above the bottom and into the separation vessel. For the purposes of this invention a dense catalyst phase is defined as a catalyst density of at least 20 lb/ft$^3$. The dense catalyst phase extends upward within the lower portion of the separation vessel to a height above the restricted openings. In this arrangement the restricted openings or nozzles are located above the bottom of the separation vessel to maintain a head of dense catalyst between the restricted openings and the bottom of the separation vessel. This head of catalyst forces at least a portion of the gases from the reactor to flow into the separation vessel through the restricted openings instead of the bottom separation vessel opening since the pressure in the reactor vessel always exceeds the pressure in the separation vessel at the restricted openings. The head of catalyst in the separation vessel below the restricted openings will remain greater than the pressure drop across the restricted openings so that all of the gas from the reactor vessel will flow through the restricted openings and undergo redistribution before stripping catalyst in the separation vessel.

Catalyst exits the bottom of the stripping zone through an outlet 15 into a catalyst regenerator 4 that supplies fresh catalyst to catalyst conduit 13. Catalyst regenerator 4 rejuvenates the catalyst by contact with an oxygen-containing gas. High temperature contact of the oxygen-containing gas with the catalyst oxidizes coke deposits from the surface of the catalyst.

A product stream, relatively free of catalyst particles and including the stripping fluid, exits the reactor vessel 10 from cyclone 23 through outlet 24. Outlet 24 provides an outlet that delivers the primary cracked product to a line 25. Line 25 transfers the product stream containing the cracked product to a fractionator 26 in the form of a main column. A variety of products are withdrawn from the main column. In this case, main column 26 recovers an overhead stream of light products comprising unstabilized gasoline and lighter gases. Line 27 transfers the overhead stream through a condenser 128 and a cooler 29 before it enters a receiver 30. Line 31 withdraws a light off-gas stream from the receiver 30. A bottom liquid stream of unstabilized gas leaves receiver 33 via line 32. Main column 26 also recycles a heavy naphtha stream and a light cycle oil stream through reflux loops 34 and 36, respectively. A heavy naphtha product may be recovered through a line 37 and a light cycle oil product may be recovered via line 38. A clarified oil fraction may be recovered via a line 39 from a reboiler loop 40. The main column 26 also circulates a heavy cycle oil stream through a loop 42.

In accordance with this embodiment of the invention, a portion of the heavy cycle oil withdrawn via a line 44 from the main column passes to a second contacting conduit in the form of a riser 43. Riser 43 contacts the heavy cycle oil feed with regenerated catalyst withdrawn from regenerator 4 by a conduit 144. A conduit 45 lifts the catalyst from line 44 into contact with a dispersion of the heavy cycle oil provided by inlet nozzles 46. Typically, the catalyst circulation rate through the contacting conduit and the input of feed and any lift gas that enters the riser will again produce a flowing density of between 3 $lbs/ft^3$ to 20 $lbs/ft^3$ and an average velocity of about 10 ft/sec to 100 ft/sec for the catalyst and gaseous mixture. However, to provide higher severity operating conditions the recontacting conduit will operate with a higher catalyst circulation. Typically the secondary conduit will have a catalyst to oil ratio in a range of from 10–14, with ratios of 10–12 being particularly preferred. Again, the length of the riser will usually be set to provide a residence time of between 0.5 to 10 seconds at these average flow velocity conditions. Higher severity conditions in the secondary contacting conduit will usually include higher temperature conditions that are normally above 950° F. and more typically in a range of from 1000 to 1200° F. with temperatures in the range of 1000 to 1100° F. being particularly preferred.

The reacted heavy cycle oil passes upwardly through the contacting riser 43 and passes out of a lateral alarm 47. Arm 47 defines a downwardly projected outlet opening 48 that provides and initial separation of the catalyst particles from the recracked heavy cycle oil. Any type of separation device may be used at the end of the riser. Suitable separation devices should permit recovery of at least 90 wt. % of the gaseous products from the secondary conversion conduit that enter the separation zone. A first gas outlet withdraws the recovered riser gaseous products from the separation zone. The catalyst particles flow downwardly and collect in catalyst bed 28 together with the small amount of catalyst recovered by cyclone 23. Cyclone 22 recovers the recracked heavy cycle oil and the accompanying lighter products through an opening 49. Cyclone 22 separates any entrained catalyst from the recracked products and returns the recovered catalyst to bed 28. A conduit 50 defines an outlet that transfers the recracked product to a secondary column 51 via a line 52. Secondary column 51 recovers unconverted heavy cycle oil from a reboiler loop 53 via a line 54. Additional light cycle oil is recovered from secondary column 51 through a line 56 at a location above a reflux loop 55. Additional light cycle oil may be separately recovered from line 56 or, as shown in FIG. 1, returned to the main column 26 for further separation—preferably via line 25.

This invention can employ a wide range of commonly used FCC catalysts. These catalyst compositions include high activity crystalline alumina silicate or zeolite containing catalysts. Zeolite catalysts are preferred because of their higher intrinsic activity and their higher resistance to the deactivating effects of high temperature exposure to steam and exposure to the metals contained in most feedstocks. Zeolites are usually dispersed in a porous inorganic carrier material such as silica, aluminum, or zirconium. These catalyst compositions may have a zeolite content of 30% or more. Particularly preferred zeolites include high silica to alumina compositions such as LZ-210 and ZSM-5 type materials. Another particularly useful type of FCC catalysts comprises silicon substituted aluminas. As disclosed in U.S. Pat. No. 5,080,778, the zeolite or silicon enhanced alumina catalysts compositions may include intercalated clays, also generally known as pillared clays.

Feeds suitable for processing by this invention, include conventional FCC feedstocks or higher boiling hydrocarbon feeds. The most common of the conventional feedstocks is a vacuum gas oil which is typically a hydrocarbon material having a boiling range of from 650–1025° F. and is prepared by vacuum fractionation of atmospheric residue. Such fractions are generally low in coke precursors and heavy metals which can deactivate the catalyst.

The invention is also useful for processing heavy or residual charge stocks, i.e., those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Due to these deleterious effects, metal management procedures within or before the reaction zone may be used when processing heavy feeds by this invention. Metals passivation can also be achieved to some extent by the use of appropriate lift gas in the upstream portion of the contacting conduit.

Although the figure shows this invention being used with a riser arrangement having a lift gas zone. A lift gas zone is not a necessity to enjoy the benefits of this invention.

Figure 2:
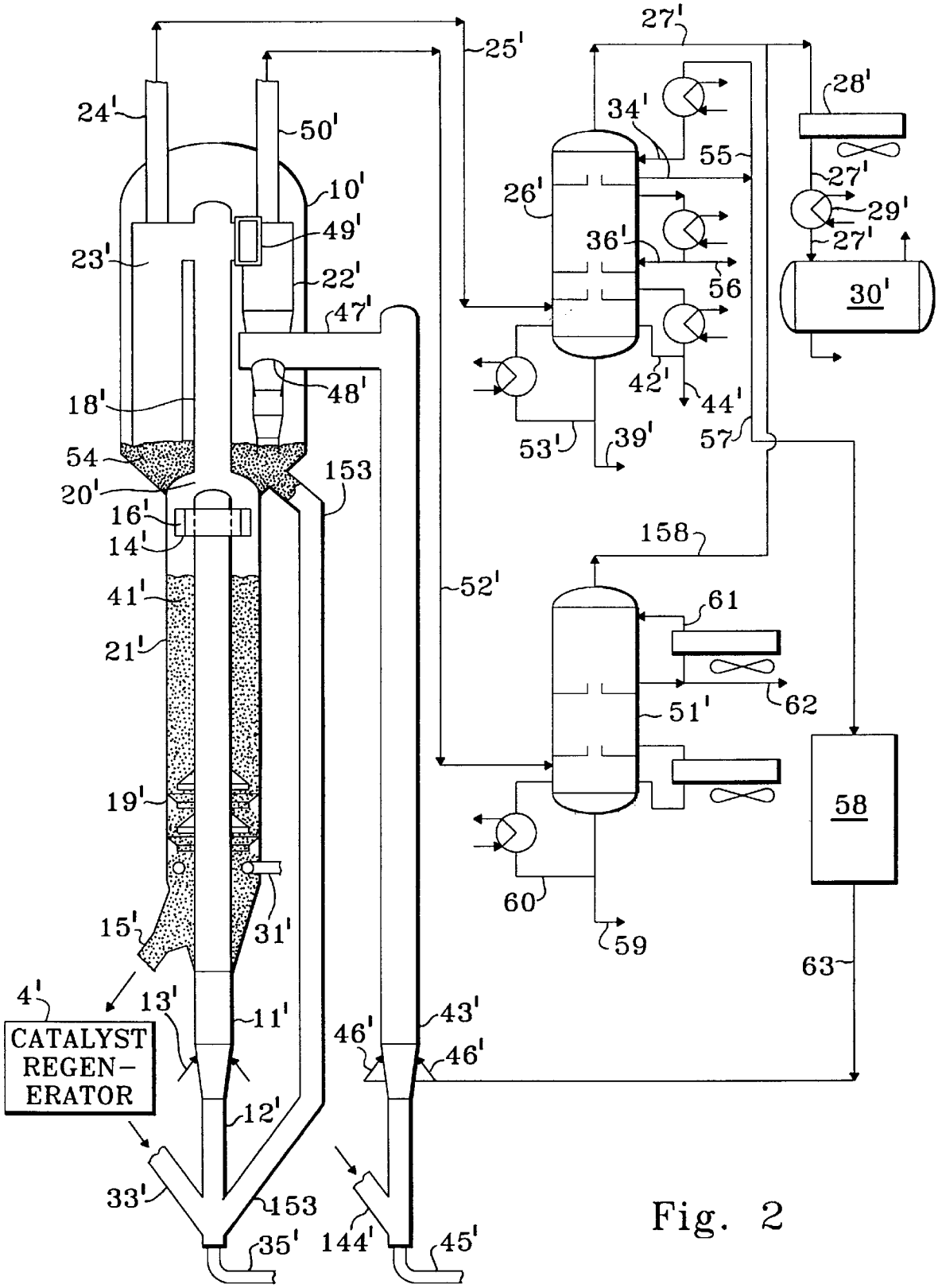
FIG. 2 is an alternate arrangement for an FCC reactor of this invention and a separation system for recovering a heavy naphtha product.

In another embodiment, the process may be arranged to recycle the catalyst from the secondary contacting conduit to the primary contacting conduit. This arrangement preferably applies to the operation to process for preferential production of light olefins and aromatic gasoline having a high motor octane number. FIG. 2 shows such an arrangement wherein catalyst from a regenerator 4' enters a catalyst supply conduit 33'. Catalyst from supply conduit 33' enters a lower section 12' of a riser 11'. Lower section 12' mixes regenerated catalyst with spent catalyst from a transfer conduit 153. A lower conduit 35' supplies a lift medium to contact the mixture of catalyst with a primary feed that enters through feed injectors 13'. The riser 11' passes upwardly through the interior of a separation vessel 21' that extends partially into a reactor vessel 10'. Arms 14' having tangentially oriented openings 16' effect a similar separation for the separation of catalyst particles into a bed 41', as previously described while vapors exit separation vessel 21' through an opening 20' and a conduit 18'. Conduit 18' transfers the primary cracked product to a cyclone 23' for removal of any small amounts of entrained catalyst. Cyclone 23' has an unrestricted open bottom. Small amounts of additional entrained catalyst from the vapors exiting through cyclone 23' pass into a bed 54 located in the bottom of reactor vessel 10'. An additional line may be provided to return catalyst directly from bed 54 to separation vessel 21'. Separated catalyst from bed 41' passes downwardly through a stripping zone 19' where it countercurrently contacts a stripping gas entering through a pipe distributor 31'. An outlet 15' transfers stripped catalyst from stripping zone 19' to catalyst regenerator 4'.

A conduit 24' recovers the primary cracked product for transfer to a main column 26' via a line 25'. In this embodiment, the main column functions in a similar manner and again recovers an overhead stream containing light gases and unstabilized gasoline that enters a receiver 30' after passing through a condenser 28' and a cooler 29' via a line 27'. In this embodiment, a recycle loop 34' again refluxes heavy naphtha while a lower recycle loop containing heavier boiling materials recycles the light cycle oil via a loop 36'. The main column also circulates a heavy cycle oil stream through a recycle loop 42' and reboils a bottom stream of clarified oil through a reboiler loop 53'. Heavy cycle oil product and clarified oil may be withdrawn through lines 44' and 39', respectively.

This arrangement of the process seeks to maximize the production of light olefins and high octane aromatic gasoline by recycling heavy naphtha and/or light cycle oil. The heavy naphtha may be recovered from recycle loop 34' via a line 55 and the light cycle oil may be recovered from the recycle loop 36' via a line 56. A line 57 takes the intermediate cut of heavy naphtha and/or light cycle oil from the main column to a hydroprocessing zone 58 that may provide saturation of condensed aromatic ring components and/or desulfurization of sulfur compounds from the recycle stream. In addition, hydroprocessing zone 58 may provide selected hydrocracking of heavier compounds within the recycle stream.

The hydroprocess stream passes from hydroprocessing zone 58 to a secondary contacting conduit 43' via a line 59. A secondary catalyst supply conduit 144' feeds regenerated catalyst from catalyst regenerator 4' into the bottom of riser 43' and into contact with a lift medium supplied to the riser through a conduit 45'. Feed injectors 46' disperse the recycled product fraction into the regenerated catalyst mixture. The recracking reaction zone provides ideal reaction conditions for the dealkylation of the heavy gasoline feed and the possible cracking of hydro aromatics. The small alkyl groups on the cyclic hydrocarbons become very refractory to any dealkylation, therefore, higher severity cracking activity is needed to partially remove these alkyl groups.

Contact with the catalyst produces a recracked recycle product that exits riser 43' through an arm 47'. Again, a downward directed opening 48' effects an initial separation between the catalyst and the recracked products. Catalysts from outlet 48 provides the majority of the catalyst retained in bed 54. Conduit 153 withdraws the partially spent catalyst from bed 54 and transfers it to the bottom section 12' of riser 11' as previously described. Catalyst collecting in bed 54 although having received some coke deposition, still has sufficient surface area for catalytic use. Typically, the coke concentration of the catalyst in this bed will be less than 1.5 wt %, more typically less than 1 wt % and preferably less than 0.6 wt. %.

An inlet 49' withdraws the recracked recycle product from the interior of reactor 10'. Cyclone 22' separates any entrained catalyst particles from the recracked recycle product and returns it to bed 54. A conduit 50' provides an outlet for transferring the recracked recycle product to a secondary column 51' via line 52'. Secondary column 51' recovers a light gas stream via an overhead line 158 that enters receiver 30' via line 27' for common recovery with the gas and unstabilized gasoline streams from main column 26'. An unconverted heavy fraction from the recracked recycle product exits the bottom of secondary column 51' from a reboiler loop 60 via a line 59. A heavy naphtha product circulates through a cooling loop 61. A line 62 recovers a net product stream of heavy naphtha that provides a gasoline stock having high aromatics content and high motor octane number.

When operating for the production of gasoline, the process typically separates the primary gaseous products into a product stream comprising light gasoline having an end boiling point at a first temperature in a range of 300 to about 400 a heavy gasoline feed having an initial boiling point at about said first temperature and an end boiling point at a second temperature above 400° F. and a first cycle oil stream having an initial boiling point at about said second temperature. The light gasoline fraction is typically withdrawn with an initial boiling point in the $C_5$ range. Preferably the end point of the light gasoline in the 300–400° F. range has a temperature of about 380° F. Olefin recracking and hydrogen transfer reactions in the recracking conduit will crack and saturate olefins to light paraffins, therefore, excessive olefin recycle with the heavy gasoline should be controlled. In its most basic form, the upper end of the heavy gasoline cut is selected to retain $C_{12}$ aromatics. The $C_{12}$ to $C_9$ aromatics in the heavy gasoline fraction are readily dealkylated. The cut point for this fraction is preferably selected to retain olefins which would otherwise be lost to additional cracking to lighter components and saturation by the recycle of the heavy gasoline fraction. The heavy gasoline stream comprises the next heavier fraction boiling above the light gasoline fraction. At the preferable operating conditions of the main column, this cut point will be at about the boiling point of $C_9$ aromatics, in particular 1,2,4-trimethylbenzene. A lower cut point temperature between the light and heavy gasoline, down to about 320° F., but preferably above 360°

F., will bring additional $C_9$ aromatics into the heavy gasoline recycle stream. However, such a lower cut point also increases the olefinicity of the heavy gasoline recycle cut. The light cycle oil stream typically has an end boiling point in a range of 500–650° F. Both the heavy gasoline and the light cycle oil separated from the primary cracking products and is contacted with catalyst in the dense bed of said reaction vessel.

Any recycled portion of the heavy gasoline and light cycle oil will typically pass through a hydrotreating zone before entering the second contacting zone for recracking. When operating in the gasoline mode of this invention, higher end points for the heavy gasoline cut carry bicyclic compounds into the secondary reaction zone and bring little benefit to the process unless these bicyclic components are pre-treated. These bicyclic compounds include indenes, biphenyls and naphthalenes which are refractory to cracking under the conditions in the primary reaction zone. Therefore, the heavy gasoline will usually have an end point of about 400–430° F. and more preferably about 420° F. A second product stream from the recracking zone will typically comprise a gasoline stream having an end boiling point in a range of from 320 to about 400° F.

As mentioned the practice of this invention includes the use of the recracking conduit zone for the treatment of hydrocarbon fractions having boiling points above the heavy gasoline end point. One arrangement of this invention hydrotreats the bicyclic hydrocarbons from a light cycle oil cut to saturate the rings of the indenes and naphthalenes. Light cycle oil can pass through the hydrotreatment zone as a separate stream or together with all or a portion of the heavy gasoline fraction. The light cycle oil fraction will comprise the next hydrocarbon fraction having a boiling point above the heavy gasoline stream and will usually have an end boiling point in a range of about 500–680° F.

Hydrotreatment of the heavy gasoline cut and any light cycle oil reduces the sulfur content of the products that are withdrawn from the reactor zone. The reaction of the heavy gasoline fraction in the reactor vessel can lower sulfur concentration in the reactor vessel products by as much as 50%. Thus, recovery of the reactor vessel product stream by an additional separation zone provides a source of low sulfur products. These products can include a low sulfur light gasoline and low sulfur fuel oil.

In addition to sulfur removal, it is also believed that the reaction of the heavy gasoline with the hydrotreated light cycle oil promotes hydrogen transfer from the saturated bicyclics that suppress the conversion of the heavy gasoline components to heavier hydrocarbon species and coke. In the alternative, it may be advantageous to hydrotreat the product of the heavy gasoline recycle since it contains a lighter cut of olefins that have undergone additional cracking to light saturates and allows the hydrotreatment with low hydrogen addition and no octane loss. Hydrotreatment of the heavy gasoline product after the recracking zone can also provide a low hydrogen demand method of reducing olefin levels in the gasoline products.

The hydrotreatment of the light cycle oil, and any heavy gasoline fraction, takes place at low severity conditions to avoid the saturation of the single ring compounds in the heavy gasoline fraction. In the method of this invention, up to 100% of the light cycle oil may be hydrotreated. Hydrotreating is carried out in the presence of a nickel-molybdenum or cobalt-molybdenum catalyst and relatively mild hydrotreating conditions including a temperature of 600–700° F., a liquid hourly space velocity (LHSV) of from 0.2 to 2 and a pressure of 500 to 1500 psig.

The hydrotreating of the light cycle oil partially saturates bicyclic hydrocarbons such as naphthalene to produce tetralin. Hydrotreatment and subsequent cracking of the light cycle oil is generally known as J-cracking. J-cracking converts light cycle oils and other hydrocarbon streams comprising multi-ring aromatic hydrocarbons that are difficult to crack in a typical FCC process. The 'J' in J-cracking is a measure of unsaturation of the hydrocarbons of the general formula:

$$C^N H_{2H-J}$$

Suitable methods for carrying out J-cracking is further described in U.S. Pat. Nos. 3,479,279 and 3,356,609 which are incorporated herein by reference.

EXAMPLES

The following examples are based on engineering calculations of process operations. Process examples demonstrate the favorable operation of the dual riser arrangement of this invention with selective-recycle of primary cracked products. These examples compare the operation of a conventional FCC unit for the production of a desired product yield with the operation of the apparatus and process of this invention using the dual riser and separate recovery arrangement of this invention to obtain similar products.

Example 1

In this arrangement, a conventional FCC unit is operated to produce light olefins and a low sulfur, high motor octane aromatic gasoline. The conventional operation contacts a vacuum gas oil feed with a regenerated catalyst at a catalyst to oil ratio of 4 to 6. The feed had a sulfur content of approximately 1 wt %. Contact of the conventional feed with the catalyst in a single riser reactor produces a cracked product having the yields given in Table 1.

Example 2

In order to show the operation of the process where the desired product is light olefins and a low sulfur, high motor octane aromatic gasoline, a selective-recycle of the cracked products was simulated in a separate dual riser reaction zone. The recycle stream comprised a hydrotreated, heavy naphtha and light cycle oil having a total boiling point in a range of from 330–450° F. The recycle stream entered a separate riser conversion zone where it contacted regenerated catalyst at a catalyst to oil ratio in range of from 10 to 12. The product yields and product properties obtained from the total FCC operation with the recycle are again shown in Table 1.

A comparison of the columns for Example 1 and Example 2 in Table 1 shows a substantially higher production of $C_3$ and $C_4$ hydrocarbons with a favorable ratio of olefins to paraffins. Though the olefin ratio is slightly lower in the selective recycle case, the overall production of about 4% additional $C_3$ and $C_4$ hydrocarbons more than compensates for any loss in selectivity of olefins to paraffins. In regard to gasoline, the selective recycle operation provides more than 1 LV % of additional gasoline. Moreover, the gasoline is two numbers higher for the research octane and almost two numbers higher for motor octane than the gasoline obtained from the conventional operation. In addition, the sulfur content of the gasoline is dramatically reduced by the selective recycle operation that hydrotreats the limited volume of the total gasoline product. Accordingly, the recycle contacting conduit provides a high severity paraffin recracking zone that provides additional hydroaromatic conversion with aromatic dealkylation and hydrogen transfer reactions that increases the production of $C_8$ and lighter aromatic gasoline while also providing additional quantities of light olefins.

TABLE 1

| | EXAMPLE 1 | EXAMPLE 2 |
|---|---|---|
| PRODUCT YIELDS | | |
| $C_2$-wt % | 3.2 | 4.4 |
| $C_3/C_4$ LV % | 10.7/15/4 | 14.9/19.2 |
| $C_5^+$ Gasoline LV % | 60.0 | 61.3 |
| LCO LV % | 13.9 | 6.2 |
| CO LV % | 9.2 | 9.6 |
| COKE wt % | 5.0 | 6.3 |
| PRODUCT PROPERTIES LPG | | |
| $C_3$=/$C_3$'s Vol % | 76.4 | 76.0 |
| $C_4$=/$C_4$'s Vol % | 58.3 | 56.0 |
| GASOLINE | | |
| RONC/MONC | 93.2/80.4 | 95.3/82.0 |
| 5 wt ppm | 1280 | 205 |

Example 3

In the simulation of this example, a conventional FCC riser contacts an FCC feed to preferentially produce liquefied petroleum gas (LPG) and middle distillate products. The conventional riser operation contacts the feed with a regenerated catalyst and produces product yields as shown in Table 2.

Example 4

In this operation a dual riser arrangement, as shown in this invention, is simulated with independent recovery of unconverted condensed-ring aromatics from the recracked, recycle products. The recycle stream in this example comprises a heavy cycle oil and clarified oil stream from a main column. Again, the riser operates at relatively higher severity than the conventional riser that initially contacts the primary feed with regenerated catalyst. Products obtained from the recycle of the recracked product fraction are shown in Table 2. The recovered gasoline has an ASTM 90% boiling point of 300° F. The light cycle oil stream has an ASTM 90% boiling point of 670° F.

A comparison of the product yields from the two operations predict generally improved yields of LPG gasoline and light cycle oil by reduced production of clarified oil with only a slight increase in the overall coke make. Dry gas production is slightly lowered by the operation. LPG production rises by almost 1 Liquid Volume % while gasoline has a significant increase of almost 5 Liquid Volume %. Similarly, the light cycle oil increases by over 2Liquid Volume %. Clarified oil production drops significantly by the recycle of the heavy stream with only a minor increase in the overall coke make to the process. The absence of hydrotreatment of the heavy stream leaves the mainly condensed ring aromatics as the non-reacting compounds.

Accordingly, these examples demonstrate the advantages of a dual contacting conduit arrangement that sequentially contacts a recycle fraction of the cracked product and independently recovers the two fractions for separate recovery and isolation into product streams.

TABLE 2

| PRODUCT YIELDS | EXAMPLE 3 | EXAMPLE 4 |
|---|---|---|
| $C_2$-wt % | 2.6 | 2.0 wt % |
| $C_3/C_4$ LV % | 6.9/9.8 | 7.6/10.7 LV % |
| $C_5^+$ Gasoline LV % | 43.3 | 48.0 LV % |
| LCO LV % | 37.4 | 39.6 LV % |
| CO LV % | 7.6 | 1.7 LV % |
| COKE wt % | 4.9 | 5.1 wt % |

What is claimed is:

1. A process for the catalytic conversion of heavy hydrocarbons by the sequential fluidized cracking and recracking of feed and product fractions, said process comprising:

a) contacting a hydrocarbon feed with regenerated catalyst particles in a first conduit;

b) discharging the mixture of feed and catalyst particles into a first particle separator and separating a first contacted stream of particles from a converted feed;

c) recovering converted feed from the first particle separator;

d) separating converted feed into a relatively heavy stream and a relatively lighter stream;

e) saturating at least a portion of the relatively lighter stream in a saturation zone to produce a recycle stream;

f) contacting the recycle stream with regenerated catalyst particles in a second conduit to recrack the recycle stream and produce a recycle product;

g) discharging the mixture of recycle product and catalyst particles into a second particle separator and separating a second contacted stream of particles from the recycle product;

h) recovering the recycle product without substantial intermixing with the converted feed;

i) passing the first and second contacted stream of particles to a stripping zone and stripping hydrocarbon vapors from the first and second contacted streams of particles in the stripping zone to produce stripped catalyst particles; and, j) regenerating the stripped catalyst particles in a regeneration zone to provide regenerated catalyst particles.

2. The process of claim 1 wherein the hydrocarbon feed has an initial boiling point of at least 400F.

3. The process of claim 1 wherein a portion of the second contacted stream of catalyst particles passes from the second particle separator to the first conduit.

4. The process of claim 1 wherein the relatively light stream comprises heavy naphtha or light cycle oil and has a boiling point of at least 330F.

5. The process of claim 1 wherein the saturation zone comprises a hydrotreatment zone.

6. A process for producing gasoline from a hydrocarbon feed stream having an initial boiling point of at least 400F by the sequential fluidized cracking and recracking of feed and product fractions, the process comprising:

a) contacting a hydrocarbon feed with regenerated catalyst particles and partially spent catalyst particles in a first conduit at a first weight ratio of catalyst to oil;

b) discharging the mixture of feed and catalyst particles into a first particle separator and separating a first contacted stream of particles from a converted feed;

c) recovering converted feed from the first particle separator;

d) separating the converted feed into a relatively a relatively light stream having an initial boiling point below 400F and relatively heavier stream;

e) saturating at least a portion of the relatively lighter stream in a saturation zone to produce a recycle stream;

f) contacting the recycle stream with regenerated catalyst particles in a second conduit at a second weight ratio of catalyst to oil to recrack the recycle stream and produce a recycle product, wherein the second ratio is higher than the first ratio;

g) discharging the mixture of recycle product and catalyst particles into a second particle separator and separating a second contacted stream of particles from the recycle product;

h) passing at least a portion of the second stream of contacted particles from the second particle separator to the first conduit to supply the spent catalyst;

i) recovering the recycle product without substantial intermixing with the converted feed;

j) passing the first and second contacted stream of particles to a common stripping zone and stripping hydrocarbon vapors from the first and second contacted streams of particles in the stripping zone to produce a stripped catalyst particles; and, k) regenerating the stripped catalyst particles in a regeneration zone to provide regenerated catalyst particles.

7. The process of claim 6 wherein the first ratio is less than 10 and the second ratio is at least 10.

8. The process of claim 6 wherein a third particle separator recovers a third stream of contacted particles from the converted feed and the third stream of contacted particles collect with the second stream of contacted particles in the a common collection zone.

9. The process of claim 6 wherein the converted feed passes to first fractionation zone that supplies the relatively lighter feed and the recycle product stream passes to a second fractionation zone that recovers a gasoline boiling range product stream.

* * * * *